US011673634B2

(12) United States Patent
Howard

(10) Patent No.: US 11,673,634 B2
(45) **Date of Patent: *Jun. 13, 2023**

(54) INFLATABLE WATERCRAFT BARRIER

(71) Applicant: Dean Richard Howard, Runaway Bay (AU)

(72) Inventor: Dean Richard Howard, Runaway Bay (AU)

( * ) Notice: Subject to any disclaimer, the term of this patent is extended or adjusted under 35 U.S.C. 154(b) by 113 days.

This patent is subject to a terminal disclaimer.

(21) Appl. No.: 17/307,918

(22) Filed: May 4, 2021

(65) Prior Publication Data

US 2021/0253205 A1 Aug. 19, 2021

Related U.S. Application Data

(63) Continuation of application No. 16/599,043, filed on Oct. 10, 2019, now Pat. No. 10,994,817.

(60) Provisional application No. 62/744,514, filed on Oct. 11, 2018.

(51) Int. Cl.
*B63C 1/02* (2006.01)
*B63C 1/06* (2006.01)

(52) U.S. Cl.
CPC . *B63C 1/02* (2013.01); *B63C 1/06* (2013.01)

(58) Field of Classification Search
CPC .... B63C 1/00; B63C 1/02; B63C 1/06; B63B 59/00; B63B 59/04; B63B 59/045
USPC ..... 114/45
See application file for complete search history.

(56) References Cited

U.S. PATENT DOCUMENTS

| | | | |
|---|---|---|---|
| 8,739,724 | B2 | 6/2014 | Howard |
| 10,994,817 | B1 | 5/2021 | Howard |
| 2010/0007949 | A1 | 1/2010 | Clawson et al. |
| 2010/0297897 | A1 | 11/2010 | Ibsen |
| 2017/0284402 | A1 | 10/2017 | Howard |

*Primary Examiner* — Lars A Olson
(74) *Attorney, Agent, or Firm* — Puget Sound Patents; Dwayne E. Rogge

(57) ABSTRACT

Disclosed herein is an inflatable watercraft barrier in one example having an inflatable perimeter tube. Also disclosed is a diaphragm sealed to the perimeter tube to form the watercraft barrier between a watercraft and the water in which the watercraft barrier and watercraft float. In one example, a portion of the perimeter tube forms a gate portion which is at least partially selectively deflated so as to be denser than water, and therefore rotates about a gate pivot such that the watercraft may enter the watercraft barrier through the gate portion. Also disclosed is a water pump in fluid communication with the watercraft barrier so as to evacuate water from between the watercraft barrier and the watercraft.

10 Claims, 4 Drawing Sheets

INFLATABLE WATERCRAFT BARRIER

RELATED APPLICATIONS

This application is a continuation of U.S. Ser. No. 16/599,043 filed Oct. 10, 2019, which claims priority benefit of U.S. Provisional Ser. No. 62/744,514 filed Oct. 11, 2018, each incorporated herein by reference.

BACKGROUND OF THE DISCLOSURE

Field of the Disclosure

This application relates to the marine field of dry-docks where a marine vessel (watercraft/boat) is substantially removed from contact with surrounding environmental water, by removing a substantial portion of the water, rather than removing the vessel.

U.S. Pat. No. 8,739,724 discloses an inflatable dry dock having a perimeter portion, a gate portion, and a mechanism allowing a user to close the gate and drain the water from a barrier layer.

U.S. patent application Ser. No. 15/476,501 discloses a specialized sensor for use in pumps. Such sensor and pumps in one example are well suited for the apparatus disclosed herein.

BRIEF SUMMARY OF THE DISCLOSURE

Disclosed herein is an inflatable watercraft barrier for use with inflatable watercraft, rigid watercraft, combinations thereof, and equivalents. The watercraft barrier in one example comprising: an inflatable perimeter tube having a port portion, a starboard portion, and a stern portion. Also disclosed is a diaphragm which may be sealed to the port portion, starboard portion, and stern portion of the perimeter tube to form the watercraft barrier between a watercraft and the water in which the watercraft barrier and watercraft float. In one example the watercraft barrier is configured wherein the inflatable perimeter tube when inflated and diaphragm in combination are less dense than water, and therefore float. In one example, the stern portion of the perimeter tube forms a gate portion which is at least partially selectively deflated so as to be denser than water, and therefore sink in a rotating manner about a gate pivot. In one example the gate portion remains attached to port portion and starboard portion when deflated, and thus allows water to at least partially fill the watercraft barrier such that the watercraft may enter the watercraft barrier through the gate portion. Also disclosed is a water pump in fluid communication with the watercraft barrier so as to evacuate water from between watercraft barrier and the watercraft. Also disclosed is a one-way valve positioned between the port portion, and/or starboard portion, and the stern portion. In one example the one-way valve configured to allow air to flow between the stern portion and the port portion and/or starboard portion as the stern portion is pressurized above the pressure of the port portion, and/or starboard portion.

In a cooperating example is disclosed an inflatable watercraft barrier comprising an inflatable perimeter tube having a port portion, a starboard portion, and a stern portion. Also disclosed is a diaphragm sealed to the port portion, starboard portion, and stern portion of the perimeter tube to form the watercraft barrier between a watercraft and the water in which the watercraft barrier and watercraft float. The watercraft barrier in one example configured wherein the inflatable perimeter tube when inflated, and diaphragm in combination are less dense than water, and therefore float.

In one example, the stern portion of the perimeter tube forms a gate portion which is at least partially selectively deflated so as to be denser than water, and therefore sink in a rotating manner about a gate pivot. In one example the gate portion remains attached to port portion, and starboard portion when deflated, and thus allows water to at least partially fill the watercraft barrier such that the watercraft may enter the watercraft barrier through the gate portion.

Also disclosed is a water pump in fluid communication with the watercraft barrier so as to evacuate water from between watercraft barrier and the watercraft. Also disclosed is an air drain tube extending from the gate portion to the port portion, and/or starboard portion, the air drain tube configured to facilitate air evacuation from the gate portion when the gate portion is being deflated.

Also disclosed is a watercraft adjustment system comprising a tensile catch extending from the perimeter tube; the tensile catch configured to engage the watercraft (22) so as to maintain the watercraft (22) in position such that a drive mechanism (34) of the watercraft (22) does not contact the watercraft barrier (20) when the gate portion (52) is in the open position (70).

DETAILED DESCRIPTION OF THE DISCLOSURE

Figure 1:
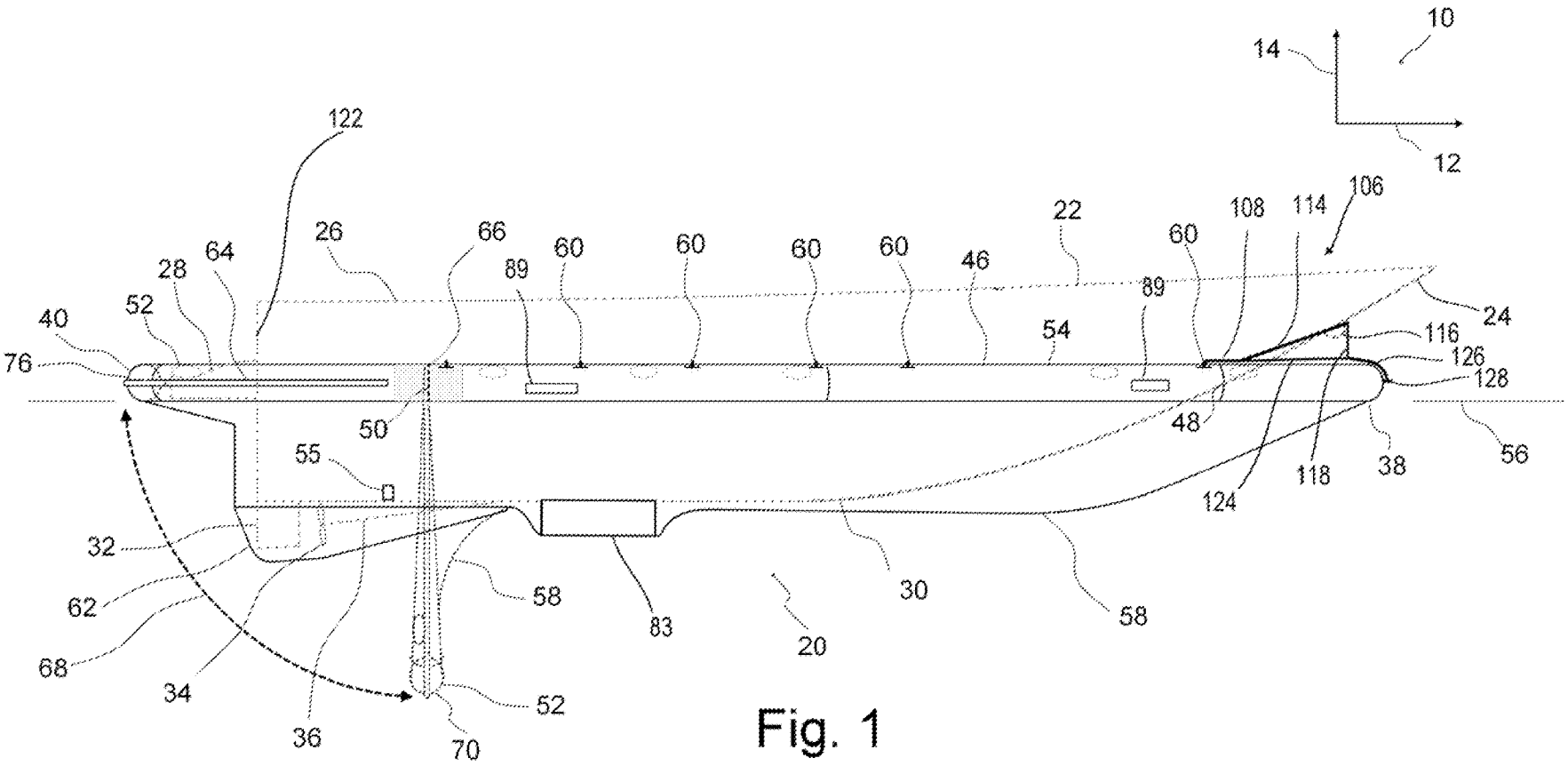
FIG. 1 is a side view of one example of the disclosure. The opposing side view is substantially a mirror image thereof.

The apparatus and methods disclosed herein are particularly useful in the field of marine moorage for watercraft such as boats, jet skis, including power boats, sail boats, barges, and similar floating vessels. Moorings are places where a ship, boat, or other watercraft may be secured in a particular place, as by cables, ropes, lines, and/or anchors. The disclosed apparatus makes it possible while mooring to reduce direct contact between the hull of the watercraft and the environmental water in which the watercraft floats. Such environmental water may be a lake, river, bay, ocean, marina, etc. In use, some water, oxidants, organisms and corrosion agents, may be in contact with the watercraft, these known to be detrimental to the watercraft. These may allow marine growth on the vessel, also detrimental. The effects of marine organisms, corrosion agents, chemical oxidants, and electric currents are substantially reduced by use of the watercraft barrier disclosed herein when positioned between the watercraft and the environmental water.

Another benefit of separating the watercraft from the environmental water is to reduce the likelihood that the watercraft taking on water (sinking) due to a hole, crack, or permeable region of the hull of the watercraft. For example, through-hull fittings for water intake and fluid (liquid and gas) egress periodically fail, cracking or corroding, potentially resulting in water entry into the watercraft. If such water entry occurs when the watercraft is not occupied, if a bilge pump fails, if a bilge pump is inadequate for the volume of water entering the watercraft, etc., then there is a significant likelihood that the watercraft may sink or become damaged due to contact with the water.

In addition to potential water entry problems when water intrudes into the watercraft, chemical corrosion/oxidation, and marine organism growth can damage a watercraft hull, and/or cause performance and visual appeal deterioration. This is a known problem normally addressed by providing a hull coating on the watercraft or removing the watercraft from the environmental water during storage. Hull coatings, for example paint, are specifically engineered to retard marine growth; none of such coatings are perfect and thus do not eliminate corrosion nor marine organism growth of the watercraft hull. In a saltwater environment for example, algae, fungus, barnacles, mussels, and other marine life may attach themselves to the hull of the watercraft and grow there. This growth not only is aesthetically displeasing, but also negatively impacts the performance of the watercraft in motion and results in high maintenance costs, as the watercraft must be periodically removed from the water, cleaned, and re-coated with a hull coating. Barnacles and similar organisms especially cause damage as their cement glands often permeate into and through barrier coatings into the hull of the watercraft. Over time this condition results in significant repair cost to remove the vessel from the water, remove the growth, and repair the damaged portion of the watercraft hull.

Thus, to fully eliminate water entry, corrosion, and marine growth; where possible, watercraft are often removed from the water for storage rather than being kept at a dock, anchorage, or moorage in the water. This dry storage is often expensive and often undesirable, especially for larger watercraft. In addition, repositioning the watercraft from the dry storage to the water is often time-consuming, potentially dangerous, and financially expensive.

The apparatus and method described herein overcomes the detriments above and others by providing a watercraft barrier between the hull of the watercraft, while the watercraft is still in the water and at a dock. The watercraft barrier in one example is waterproof, not allowing water entry once a gate section is closed.

In one example the barrier system is accomplished without the use of chemicals which are often used to retard the growth of aquatic organisms. In addition, the watercraft barrier provides a resilient inflated perimeter to which further protects the hull of the vessel from accidental contact with, and damage from the dock and other rigid elements which it may contact such as other watercraft.

The watercraft barrier disclosed herein improving over the known prior art in several respects. These improvements including: an air drain hose eliminating deflation errors, a method for simultaneously inflating the gate portion and re-pressurizing other perimeter tube portions, and a watercraft adjustment system which engages the watercraft during entry into the watercraft barrier allowing adjustment of the longitudinal position of the watercraft relative to the watercraft barrier.

Figures 2, 2A, 2B, 2C, 2D:
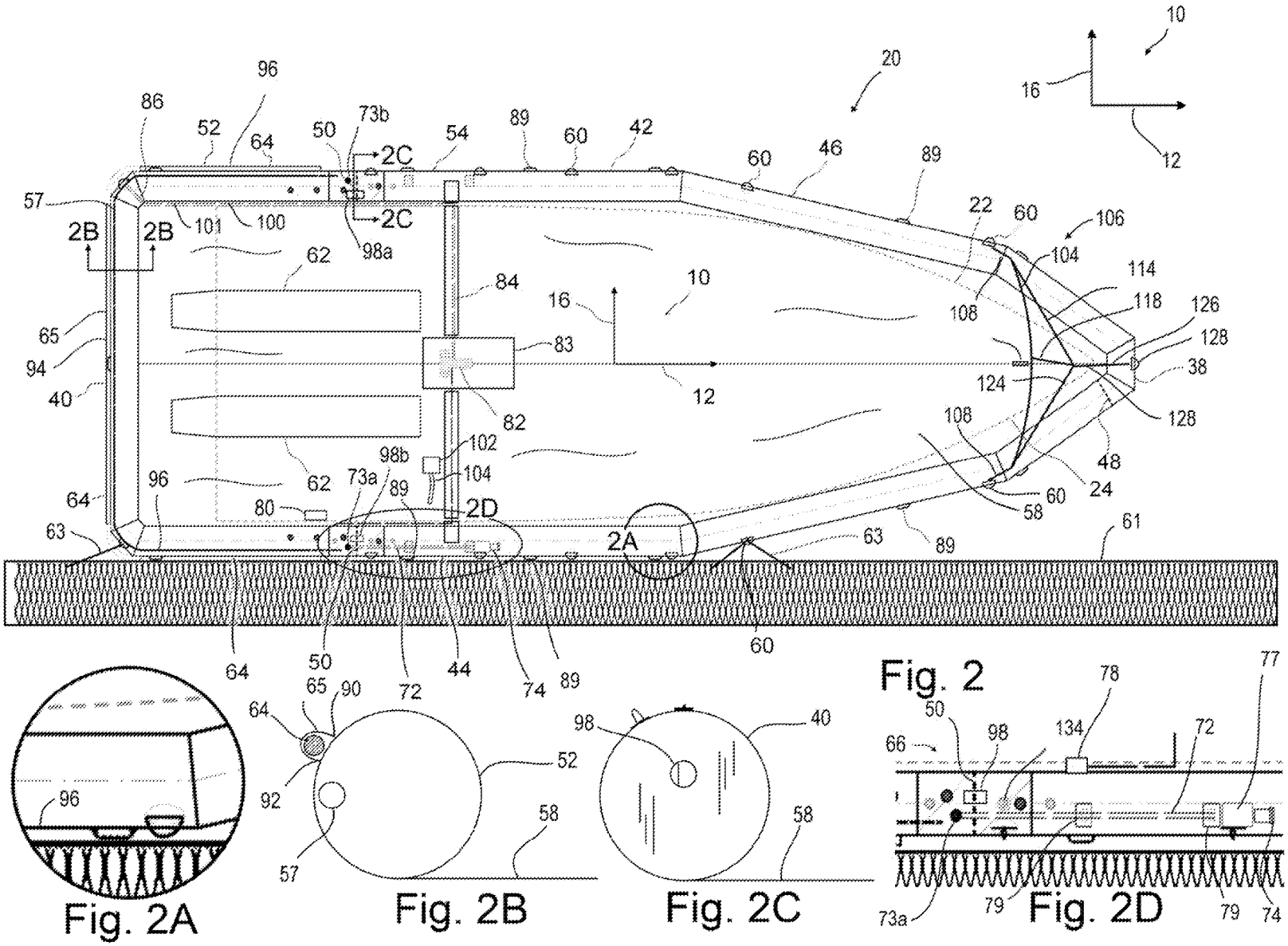
FIG. 2 is a top or plan view of the example shown in FIG. 1.
FIG. 2A is an enlarged view of the region 2A of FIG. 2.
FIG. 2B is a cutaway view taken along line 2B-2B of FIG. 2.
FIG. 2C is a cutaway view taken along line 2C-2C of FIG. 2.
FIG. 2D is an enlarged view of the region 2D of FIG. 2.
Figure 3:
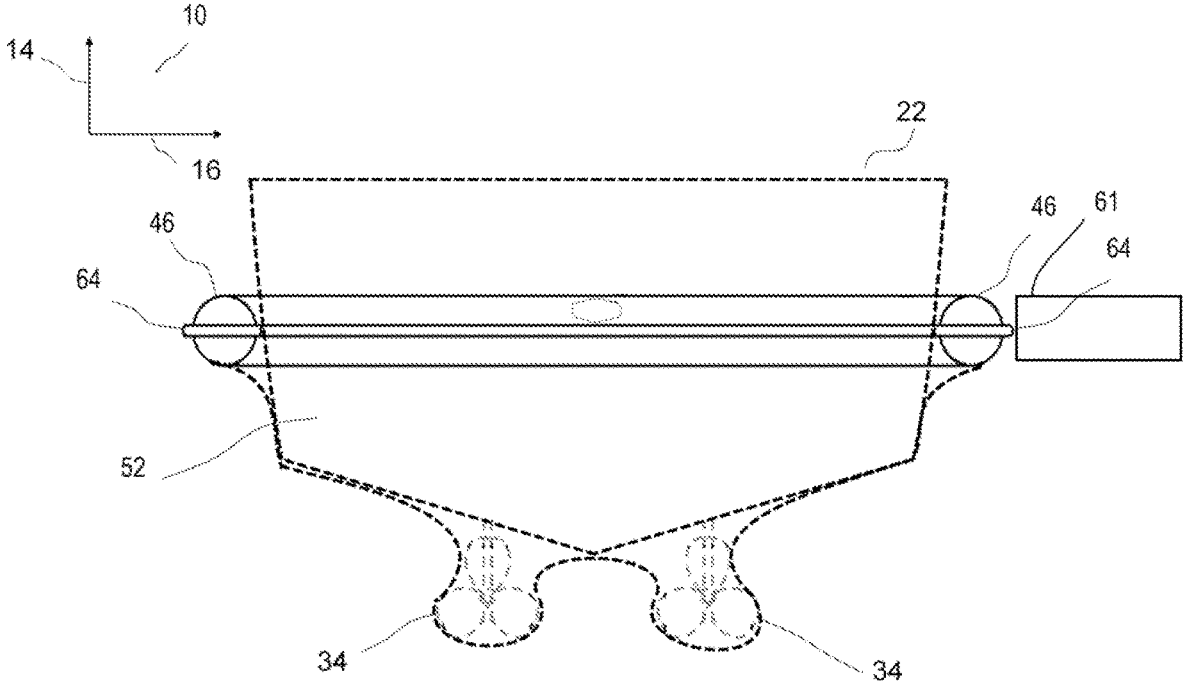
FIG. 3 is a rear view of the example shown in FIG. 1.

Before beginning a detailed description, an axes system 10 is shown in FIGS. 1, 2, and 3. This axes system generally comprising a longitudinal axis 12 which as shown in the particular example of FIG. 1 points in a forward direction towards a bow portion of the vessel, a vertical axis 14 which as shown in the particular example of FIG. 1 points in an upward direction, and a transverse axis 16 which as shown in the particular example of FIG. 2 points in a left, or port direction with the opposite direction being right or starboard. To continue with the nautical terminology used herein, the longitudinally rearward portion of the apparatus and of the watercraft will be called the stern of each.

This axes system and the directions indicated are provided for ease and understanding of the disclosure and are not intended to limit the apparatus to a particular orientation.

To explain the apparatus and use of the watercraft barrier 20, general components of a watercraft 22 (boat, barge, ship, dory, etc.) are described herein. It is intended that other watercraft 22 of various configurations may be used with the watercraft barrier 20 such as sailboats, personal watercraft, rowboats, sailboats, jet skis, etc.

Looking to FIG. 1 is shown one example of a watercraft barrier 20 with a watercraft 22 therein. The watercraft 22 of this example has a forward or bow portion 24, a stern portion 26 which may include a swim step 28, and a keel. Extending from the hull 30 in the example shown of a watercraft is a rudder 32 commonly used to steer the vessel, a propeller 34 used to provide motive force against the water, and a shaft 36 connecting the propeller to an engine commonly within the watercraft 22. Power driven watercraft may alternatively utilize a stern drive or outboard engine functionally equivalent to the apparatus shown relevant to the watercraft barrier 20. Other watercraft such as sailboats, rowboats, etc. may not have a shaft or propeller but may be driven by sails, oars, paddlewheels, water jet drives, or similar propulsion devices. There are many watercrafts such as barges that have no propulsion means of their own, but rather rely on the propulsion means of other watercraft (such as tugboats) to be moved.

The watercraft barrier 20 in one form comprises a forward or bow portion 38, and a stern portion 40 seen in FIG. 1. In FIG. 2, the port side 42 and starboard side 44 of the watercraft barrier 20 can be easily seen and distinguished.

Looking to FIG. 1, the watercraft barrier 20 of this embodiment generally comprises an inflatable perimeter tube 46 which may be internally segregated (divided) at multiple points by one or more bulkheads 48. These bulkheads forming a watertight/airtight barrier between adjacent segments. In one embodiment as shown in FIG. 2, transversely aligned gate bulkheads 50 within the inflatable perimeter tube 46 distinguish a forward portion 54 of the perimeter tube 46, which is nearly constantly inflated, from a gate portion 52 of the perimeter tube 46, which may be selectively deflated and allowed to drop (pivot) the aft portion thereof below the water line 56 to allow the watercraft 22 to enter and exit the watercraft barrier 20.

Wherein the watercraft 22 includes an engine cooling water intake 55, it may be desired to configure the watercraft barrier 20 such that the water intake 55 of the watercraft 22 is aft of the gate pivot 66 when the watercraft 22 is positioned within the watercraft barrier 20. This is arranged such that as the engine draws water through the intake 55, the diaphragm 58 does not occlude the intake 55, nor dopes any other portion of the watercraft barrier 20. By so arranging the apparatus, the drive mechanism can continue to operate when the watercraft 22 is within the watercraft barrier without overheating or damaging components as the gate portion 52 is in the open position 70.

During operation, the gate portion 52 is deflated to allow the watercraft 22 to enter the watercraft barrier 20, and then re-inflated and pressurized to close the watercraft barrier 20 to water entry.

In one example, additional layers of material, or a more resilient material comprises the perimeter tube 46 on either side of the gate pivot 66. Similarly, reinforced seams may be provided around the gate pivot 66. With the gate portion 52 deflated there is extra pressure on this gate pivot 66, particularly in rough or strong tidal or current areas, so extra reinforcement may be desired along the tube seams in this area to prevent them from pulling apart or delaminating.

In one example, the perimeter tube 46 is configured with one or more of bulkheads 50 within the perimeter tube 46 to ensure safety should one section become punctured. In one example, these bulkheads 50 may include a one-way valve 98, allowing air to pass from the gate portion 52 to the other (port and/or starboard) portions of the perimeter tube 46 when the air pressure in the gate portion 52 rises above the air pressure in the other portions of the perimeter tube 46. Such valves commonly have a cracking pressure, and this cracking pressure is the minimum differential upstream pressure between inlet and outlet at which the valve will operate. Typically, the check valve is designed for and can therefore be specified for a specific cracking pressure. The cracking pressure thus prohibiting backflow of air into a failed region.

The one-way valves arranged in this way configured that as the gate portion 52 is re-pressurized and floats to the closed position 76 to a fully inflated and pressurized condition shown in FIG. 1, any pressure/volume losses in the other portions of the perimeter tube 46 caused by leakage, atmospheric pressure changes, or air temperature changes are corrected as these sections re-pressurized through the one-way valves.

To ease in re-inflation of the perimeter tube 46 segments, one or more perimeter tube inflation valves 74 may be attached to the perimeter tube(s) 46 to allow inflation of each segment of the perimeter tube(s) 46. These will be described in more detail.

Attached and sealed to the perimeter tube 46 of one example is a malleable diaphragm 58 or floor. The malleable diaphragm 58 in one example forms a barrier between the outer hull 30 of the watercraft 22 and the environmental water in which the watercraft 22 and watercraft barrier 20 float.

While the diaphragm 58 may be formed of various materials, including impermeable materials that do not permit the passage of water, seawater, or marine organisms, in one example it is formed of a polymer impregnated fabric, polymers, watertight/water resistant fabrics or other materials commonly used in the production of inflatable watercraft such as for example polyester reinforced polyurethane. Chlorosulfinated polyethylene (CSPE) synthetic rubber (CSM) commonly sold under the trade name "Hypalon" may also be used. Other materials such as polyvinyl chloride (PVC), polyethylene, polypropylene, and other rubber, fabric, plastics or plasticized materials may be utilized in both the formation of the formable diaphragm 58 as well as the perimeter tube 46.

To aid in connection between the watercraft barrier 20 and one or more of: the watercraft 22, the mooring dock, pilings, another vessel, an anchor, and/or other secure mooring attachment points; a plurality of lashing points 60 are provided on the watercraft barrier 20 which allow attachment of mooring lines (ropes etc.) which may be attached between the watercraft barrier 20 and one or more of the watercraft 22, the mooring dock 61, another watercraft, or other apparatus; to form a secure attachment to the watercraft barrier 20. The term lashing point used herein is intended to include beckets, cleats, d-rings, O-rings, and equivalent structures. By providing these lashing points 60 on the laterally outward/vertically upward surface of the watercraft barrier 20 they are not pressed between the perimeter tube 46 and the mooring dock 61 or other mooring structure when the watercraft barrier 20 moves due to waves, wind, water current, etc. In this position, the lashing points 60 are also not positioned between the watercraft 22 and the perimeter tube 46. In this example they are not positioned on the upward surface of the watercraft barrier 20 which may interfere for example with a person wishing to walk on the upper surface of the perimeter tube 46.

In one example, these lashing points 60 are attached to the perimeter tube 46 releasably. In one example the lashing points 60 are formed of straps, optionally nylon straps. These lashing points 60 (in one example equivalent to seat belt webbing) are attached via fabric welding, adhesives, or other methods to a specified detachment strength. In this way, if anything goes wrong such as whilst a customer is berthing their boat, one of these lashing points 60 will release from the perimeter tube 46 rather than damaging the perimeter tube 46. In one example the lashing points 60 are reflective. This makes the watercraft barrier 20 more easily visible, especially at night for passing vessels and berthing watercraft operators. This is particularly important in canals and swing mooring situations, particularly if a watercraft 22 is not berthed in the watercraft barrier 20, reducing visibility of the watercraft barrier 20.

Generally, the watercraft 22 will be attached to the mooring dock 61 through other mooring lines 63 to reduce stress on the watercraft barrier 20, although the watercraft 22 may be attached to the watercraft barrier 20 through the mooring lines 63 on a temporary basis while initially docking the watercraft 22 in the watercraft barrier 20. The mooring lashing points 60 may also provide attachment points for electrical connections, fluid conduits for air entry, water evacuation, etc.

In one example, the diaphragm 58 includes a drive mechanism pocket 62, or a plurality of pockets 62, to protect the drive mechanism such as the rudder(s) 32, propeller(s) 34, and/or shaft(s) 36 and to protect the watercraft barrier from potentially damaging contact with the rudder(s) 32, propeller(s) 34, and/or shaft(s) 36. These pockets 62 may be a shaped piece of the same material forming the malleable diaphragm 58. Such pockets 62 formed in one example by addition of additional material to the diaphragm 58 by adhesives, stitching, polymer welding, etc. and combinations thereof. The pockets 62 may compress around the rudder(s) 32, propeller(s) 34, and/or shaft(s) 36 as water is removed from them. Similar drive mechanism pockets 62 may be sized and shaped for outboard motors, sailboat keels, jet drives, and other hull projections.

In one example each drive mechanism is housed in its own individual drive mechanism pocket 62. This arrangement reduces stress on the diaphragm 58 and ensures that each drive mechanism remains dry. Each drive mechanism pocket 62 may be built with excess material and dimensions to allow movement and wrap around the drive mechanism without pulling tight. In one example a weighting system is added to each drive mechanism pocket 62 to ensure that these drive mechanism pockets drop away and release from each drive mechanism when the gate portion 52 is deflated and lowered and water enters the watercraft barrier 20 and the watercraft 22 is allowed to exit.

In one example, a watercraft barrier 20 configured for outboard powered watercraft and may comprise no drive mechanism pockets 62.

The watercraft barrier 20 may also comprise a weight bar installed on the diaphragm 58 to help flow of any air that may be trapped under the diaphragm 58 and would otherwise flow towards the transom when the gate portion 52 lowers, causing a bubble in the diaphragm 58 behind the transom of the watercraft 22 and preventing the watercraft 22 from exiting the watercraft barrier 20.

In one mode of operation, the gate portion 52 may be deflated (air evacuated), by opening a valve 74 allowing air in the gate portion 52 to evacuate. In one example, the valve 74 is a valve allowing for air or gas entry, air evacuation, and connection to a source of pressurized air via a hose or equivalent. In one example a valve such as disclosed in U.S. Pat. No. 4,478,587 incorporated herein by reference, may be utilized. Such valves being well known in the art of inflatable watercraft.

In one example, the gate portion 52, comprises or is attached to a weighted portion such as a weight tube 64 or plurality of weight tubes 64, will be heavier than water and thus pivot about the gate pivot 66 to an open position 70 where at least a portion (the stern portion 40) of the gate portion 52 is below the waterline 56 as shown in FIG. 1. In this open position 70, sections of the port side 42, starboard side 44, and other portions of the perimeter tube 46 remain inflated.

In some examples, the weight tube 64 is formed with pipes and fittings. In one example high pressure PVC plumbing pipes and fittings are used. These pipes may be cut to a pre-determined size to allow for ease of transport and or screwed or otherwise fastened together. In one example this assembly may be accomplished on-site. In one example the pipe sections and fittings are assembled to form a U-shape. The pipes and fittings may be used themselves as the weighted component. Alternatively, the pipes and fittings house separate weights, such as bars, grains, balls, fluids. In operation, the weight bar 64 maintains the gate portion 52 of the watercraft barrier 20 open when the gate portion 52 is deflated and underwater. This arrangement allowing the watercraft 22 to enter or exit the watercraft barrier 20 as well as provide protection to the watercraft 22 from any damage from other vessels or floating objects hitting the gate portion 52 of the watercraft barrier 20 when the watercraft barrier 20 is inflated. The arrangement also providing protection to the gate portion 52 should the gate portion 52 contact the bottom of the seabed or other submerged obstructions if deflated in shallow areas. These weight pipes, once installed onto the watercraft barrier 20, may also be then filled with water or other fluid or solid and sealed to hinder the weight bars from oxidizing or decaying. In one example the weights within the pipes or the weight bars comprise hot dipped galvanized solid steel bars. On large watercraft barriers 20, these weight tubes 64 may be fabricated from aluminum or other less corrosive metal. In addition, the internal weights may comprise galvanized steel bars. These tubes and/or bars may be wrapped in heat shrink to hinder electrolysis between the two dissimilar metals.

Figure 3A:
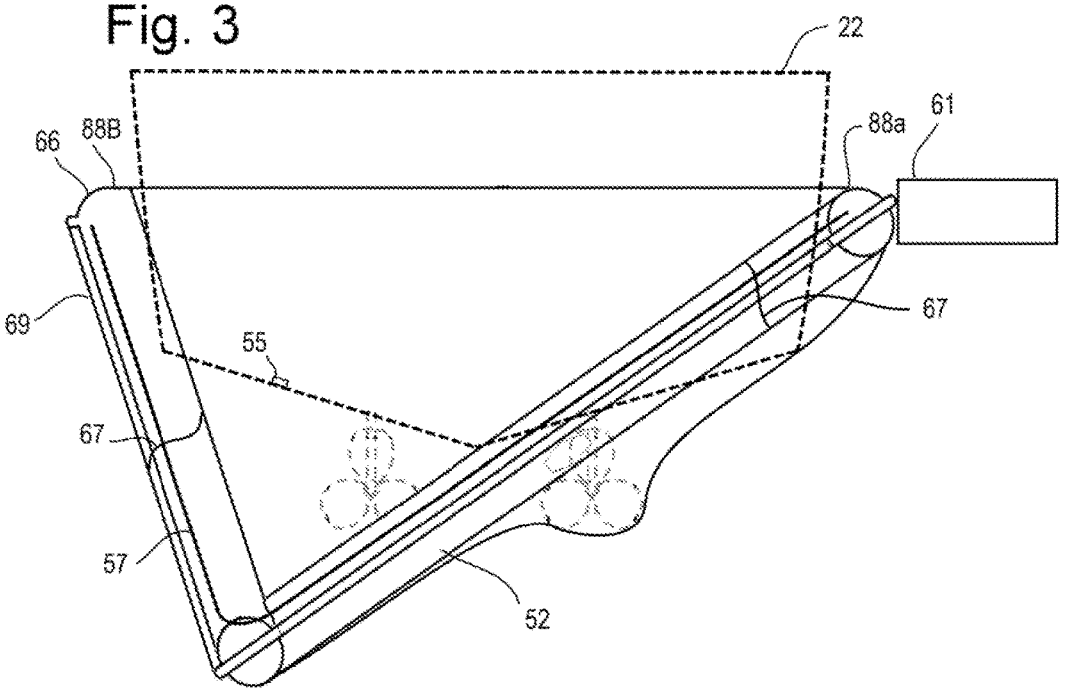
FIG. 3A is a rear view of the example shown in FIG. 1 partially deflated.
Figure 4:
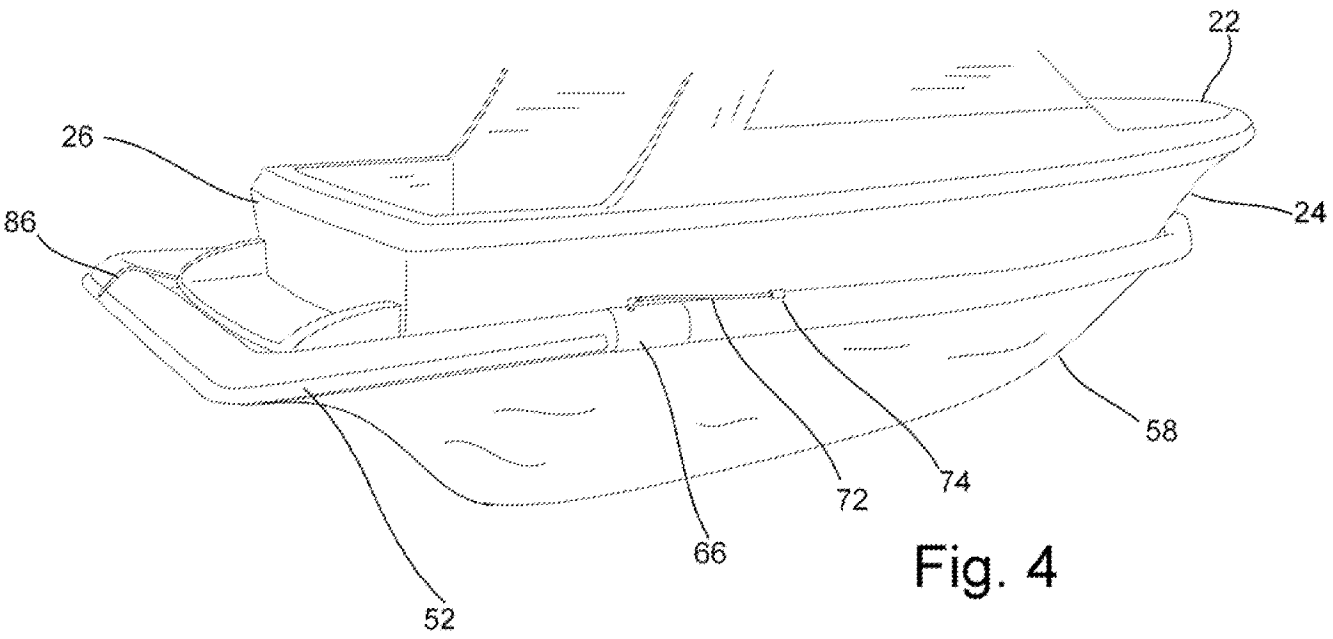
FIG. 4 is an isometric view of the example shown in FIG. 1 with a watercraft stored therein.

Looking to FIG. 3A an example can be seen comprising an air drain tube 57 having an end near the gate pivot 66 is provided. To allow substantially all of the air to be evacuated from the gate portion 52, thus allowing for the gate portion 52 to deflate and the watercraft to leave and enter the watercraft barrier 20 easily, using only one valve on one side of the watercraft barrier 20, a system has been devised that hinders an inherent air pocket that may otherwise naturally form in the gate portion 52 side furthest from an air release valve connector 73.

In one example, efficient air evacuation is achieved by mounting a drain tube 57 inside the rear tube section that forms the gate portion 52. In one example this drain tube 57 extends substantially the entire length of the gate portion 52. To further enhance this feature and prevent simple blockages such as folds in the material of the gate portion 52, the ends of this hose 57 may be perforated. These perforations may extend the entire length of the drain tube 57, or only a short length of the train tube 57, such as perforated by example for a distance of 300 mm (12 inches). This allows the drain tube to operate even the end of the drain tube 57 is occluded. The end of the air drain tube may be near where the gate inflation tube 72 attaches to the gate portion 52 at a gate inflation tube connector 73. In one example, the air drain tube 57 is perforated or segmented to allow passage of air from pockets along the gate portion 52 at various positions. As can be seen in FIG. 2, the gate inflation tube connector 73 may be provided on each transverse 16 side of the watercraft barrier 20. This allows the inflation valve 74 and attached inflation hose 72 to be attached to the port or the starboard side of the watercraft barrier 20.

In some examples, such as shown in FIG. 3A when the valve 88A on one side of the perimeter tube 46 is opened, the gate portion 52 may pivot unevenly, and a fold or crease 67 may develop between a partially inflated portion 69 and the open valve 88*a*. In such instances, air may be trapped in the section no longer having a fluid conduit to the open valve 88*a* and the gate portion 52 precluded from properly opening. Thus, the air drain tube 57 may be provided, such that air will continue to drain through the semi-rigid air drain tube 57 past the crease or fold 67 to the open valve 88*a*, thus allowing the gate portion 52 to sink or open to the open position 70. In one example, the air drain tube 57 is a bendable polymer, which is not easily crushed or creased. In one example, PVC (Polyvinyl chloride) pipe is used to produce the air drain tube 57, such that it may be easily bent, but not easily creased nor crushed.

In one example, an improved structure for holding the weight tube 64 is disclosed herein. This improved structure including a malleable pocket 65 into which the weight tube 64 is inserted. Testing has shown that many marine organisms do not grow as quickly on a malleable surface, such as the sleeve or pocket 65 as grow on a rigid surface, such as the outer surface of the weight tube 64. In the example shown in FIG. 2B, the sleeve or pocket 65 is connected by way of stitching, adhesive, polymer welding, or other methods and structures at the upper edge 90 and lower edge 92 to the gate portion 52. In one example, the pocket 65 is segmented, having an aft portion 94 extending across the stern portion 40, and side portions 96 along the port and starboard transverse sides of the gate portion 52. In one example, the pocket 65 is openable at the ends thereof, by snaps, hook and loop, or other structures to allow insertion and removal of the weight 64 which may be segmented to facilitate insertion. In one example, the aft portion 94, and side portions 96 are openable on the ends thereof.

The weight tubes 64 in one example are attached to the watercraft barrier 20 by a series of weight pockets 65 welded or otherwise attached to the outside of the gate portion 52. Industrial fabric welding uses heat and pressure to join pieces of fabric. This process is beneficial as it creates strong bonds between pieces of fabric that prevent breaks or leaks in the finished product. Fabric welding also has benefits such as: Reduced maintenance costs, Abrasion resistance, Long-lasting seam life, Smooth finishing, and Water resistance.

The corners of these weight pockets 65 in one example are open to allow for insertion and connection of the weight tubes 64. In one example the weight pockets 65 have special corner sections. These corner sections may be welded in place and may include fittings so that once the weight tubes 64 have been installed, these corner sections can be fixed into place providing a visually seamless sleeve. In one example, snap fittings are used to secure the corner sections. These weight pockets 65 hold the weight tubes 64 in place, and also provide a smooth and finished appearance. The weight pockets 65 may also provide Ultraviolet (UV) protection for the weight tubes and hinder sea growth from attaching to the weight tubes themselves. The weight pockets 65 also make removal of the weight tubes 64 easy should the watercraft barrier 20 need to be relocated to another location.

As shown, the weight tubes 64 may be external of the gate portion of the perimeter tube 46, may be included in a pocket 65, or they may be internal to the gate portion 52.

When the air within the gate portion 52 is evacuated, either by opening a valve 74 or by mechanically pumping the air within the gate portion 52 out of the gate portion 52, the gate portion 52 will then be heavier than water in part due to the weight tubes 64 and begin to pivot about the gate pivot 66 and the stern portion 40 will sink below the waterline 56. The gate portion 52 will continue to pivot about a gate pivot 66 along pivot arc 68 as shown in FIG. 1 to an open position 70. In the open gate position 70, environmental water may flow past the open gate portion 52 into/onto the diaphragm 58, and the watercraft 22 may be driven or pulled into the area defined by the perimeter tube 46 and diaphragm 58. Once in place, air may be pumped back into the gate portion 52 through a gate inflation hose 72 shown in FIG. 2. In one example, a releasable valve 74 is fitted to the end of the inflation hose 72. In one example, a valve such as disclosed in U.S. Pat. No. 4,478,587 incorporated herein by reference, may be utilized as the releasable valve 74. Such valves 74 being well known in the art of inflatable watercraft for their dependability ease of use, and ease of attachment to an inflation hose/apparatus. In the example shown, the gate inflation hose 72 is removably coupled to a source of pressurized air such as an air pump or tank through a disconnect fitting or valve 74 either on the watercraft, on the moorage dock 61, or on (in) the watercraft barrier 20. As the gate portion 52 is inflated, the gate portion 52 will become lighter than water, pivot about the gate pivot 66 from the open position 70, to a closed position 76 generally along pivot arc 68 to a closed position 76. Bulkheads 50 assist in operation of the gate, as they maintain positive air pressure in the forward portion of the perimeter tube 46, while allowing the gate portion 52 to pivot and partially sink below the waterline 56.

In one example as previously discussed, a one-way valve 98 is provided in gate bulkheads 50 as described above to re-pressurize the perimeter tube 46 for pressure losses as the gate portion 52 is pressurized.

In one example, an electric disconnect fitting 78 is attached to the perimeter tube 46. In one example this fitting 78 is positioned where it can be easily reached by an operator from within the watercraft 22, and/or from within the mooring dock 61. The electric disconnect fitting 78 is in electric communication with the water pump 82 so as to provide operating power thereto, pumping water from inside the watercraft barrier 20. In one example, the pump 82 is in a pump pocket 83 or pump box extending below the hull of the watercraft 22 so that the watercraft 22 does not contact the pump 82, potentially damaging the pump 82, watercraft 22, or paint or similar barrier coating on the watercraft 22. In one example, the pump box 83 is attached to the interior surface of the diaphragm 58. As the water is evacuated from the watercraft barrier 20 in one example, the diaphragm 58 wraps up around the pump box 83 to form a pocket below the watercraft 22. The watercraft 22 in this example then rests in part on the pump box 83. As the diaphragm 58 then continues to wrap around the watercraft 22 due to hydrodynamic pressure as the water is evacuated from the watercraft barrier 20, the watercraft 22, watercraft barrier 20 and pump box 83 are frictionally connected such that there is little or no rubbing action between them should the watercraft 22 rock due to wave motion.

A second electric disconnect fitting 80 may be on or in the watercraft 22, or alternatively on the dock 61. This fitting 80 is in electric communication with a power supply such as a battery, generator, alternator, solar panel, etc. In this embodiment, the electric disconnect (first) fitting 78 is connected to the second fitting 80 by an operator when the watercraft 22 is moored within the watercraft barrier 20 and disconnected when the watercraft is set to exit the watercraft barrier 20. Thus, electrical power may be provided to the water pump 82 to pump water through a discharge hose(s) 100 extending beyond the perimeter tube 46 so as to convey water out of the watercraft barrier 20. In one example it is desired that the discharge fitting 86 is on the side of the watercraft barrier 20 transversely offset from the mooring dock 61 to avoid flow issues and to not discharge water onto the dock 61. In one example, the discharge hose 100 passes through a discharge hose pocket 84 keeping the discharge hose 100 in proper position relative to the watercraft barrier 20. In one example, the discharge hose pocket 84 extends from the pump 82 to both the port side 42 and starboard side 44 and the discharge hose 100 selectively positioned in one or the other. In one example, the electrical conduit from the pump 82 to the disconnect fitting 76 also passes through the discharge hose pocket 84 or an adjacent pocket. In another example, the electrical conduit from the pump 82 to the disconnect fitting 76 passes through a separate sleeve than the discharge hose 100. In one example, the electrical pump cables are housed in their own discharge hose sleeve. The water hose sleeves are routed so that the water pump box 83 maintains a level position as the diaphragm 58 rises to meet the watercraft 22 as the water is evacuated from the watercraft barrier 20. This prevents the pump box 83 from being tipped sideways, placing pressure on the discharge hose(s) 100. In one example, to ease in use, the electrical conduit passes toward the side of the watercraft barrier 20 adjacent the mooring dock 61.

In one example the pump(s) 82 are redundant in one example at least two pumps 82 are installed. These are mounted in a special housing that is specifically sized so that the lid of the pump box 83 fits snuggly onto the top of the pump(s) 82 once the lid is screwed or otherwise attached place. This prevents any movement or crushing of the pump 82 from the pressure of the water underneath the watercraft 22. This pump box 83, in one example similar in shape to a shoebox, may also be perforated to provide filtration to keep debris that may have entered the watercraft barrier 22 from getting to the pump(s) 82. The pumps sit on their own cage which forms the second layer of filtration to keep any debris from entering the impeller. In one example The pump box 83 is strapped or otherwise attached to the diaphragm 58. In one example this is accomplished with an added layer of reinforcing material welded or otherwise attached to the diaphragm 58 underneath the pump box 83 to prevent damage to the diaphragm 58 from the pressure exerted by the corners and edges of the pump box 83. This pump box 83 in one example faces forward and is placed in the middle of the floor longitudinally. It may be in a position so that when the watercraft 22 is in the watercraft barrier 20 and is dried out, the pump box 83 is positioned underneath the transom 122 of the watercraft 22. The connected water hoses that direct the water out of the watercraft barrier 20, may be routed forward from the pump housing before turning towards the side of the watercraft barrier 20 and then again turning to run down underneath the perimeter tube 46 to exit the watercraft barrier 20 at the rear corner at a discharge fitting 86 by passing over the perimeter tube 46. These hoses are held in place by either sleeves welded or otherwise attached to the diaphragm 59 of the watercraft barrier 20, or straps as it goes over the perimeter tube 46.

Manual water pumps may also be used as the pump(s) 82, or electric, hydraulic, pneumatic, or venturi pumps. In one example the water pump 82 is positioned or mounted inside the watercraft 22 and connected by a tube or through-hull to an inlet positioned between the hull 30 of the watercraft and the diaphragm 58 such as near the centerline of the barrier, or within the detent or pump pocket 83.

In one form, the water pump 82 is an automatic, bilge pump which is actuated when in contact with water, and de-activated when a certain amount (level) of water is not present. The water pump 82 is normally connected through the discharge hose 100 to an overboard discharge fitting 86, as shown in FIG. 2, which directs the water beyond the watercraft barrier 20.

In one example the pumping system disclosed in U.S. patent application Ser. No. 15/476,501 filed on Mar. 31, 2017 (incorporated by reference) may be utilized to operate the water pump 82.

An impeller sensor for the (fluid impeller) pump 82 operates on a resistance design, rather than a fluid float design and incorporates electronics specifically suited to use in the watercraft barrier 20. The pump 82 commonly having an electric motor and an impeller for pumping of fluid (water). In one example, the sensor has positive and negative electric power input leads coupled to an electric power source such as household AC power, a motor-driven generator, a battery, solar cell, or other electric power source which may be mounted to the watercraft barrier 20, watercraft 22, dock 61 or elsewhere. The term "lead" is used herein to define an often flexible and insulated single conductor, as a wire, used in connections between pieces of electric apparatus.

The impeller sensor used in one example has an amperage, voltage, resistance, or power sensor electrically coupled to the power input leads of the pump 82. The sensor may be configured to sense/detect/analyze the amperage draw of the pump 82 while the pump 82 is operating, and operate a switching circuit to selectively control power to the electric motor of the pump 82 when it is desired to test the presence of a significant volume of water in the watercraft barrier and to evacuate water or other fluid therefrom.

A timer may also be connected to the system including the pump 82 and sensor. The timer configured to provide motive power to the pump 82 at a predetermined time interval.

In one example, circuitry is provided, configured to continue motive power to the pump 82 when the amperage draw of the impeller pump sensed by the amperage sensor is above a first threshold; and the circuitry may be configured to discontinue motive power to the pump 82 when the amperage draw of the pump 82 sensed by the amperage sensor falls below a second threshold.

The impeller sensor as recited above may be arranged wherein the timer is configured with: a first time interval; and a second time interval significantly longer than the first time interval. The circuitry may be configured to actuate the timer upon discontinuation of motive power to the impeller pump.

The circuitry of the impeller sensor may be configured to actuate the pump 82 upon passing of a first time interval if the amperage sensor did detect amperage draw of the impeller pump above the first threshold during the previous actuation of the impeller pump. The impeller sensor may also be arranged wherein the amperage sensor is mounted at a location remote from the pump 82, such as in the watercraft 22, on the dock 61, or on the perimeter tube 46 where it will be less susceptible to water damage. The impeller sensor as may also be arranged wherein the timer is mounted at a location remote from the pump 82, such as in the watercraft 22, on the dock 61, or on the perimeter tube 46 where it will be less susceptible to water damage.

In one example, the pump 82 may be configured to turn of after a specific volume of water has been pumped out. For example, if the watercraft barrier 22 has an internal volume of V, and the pump 82 has evacuated V+X water in a short period of time, this would generally indicate a rupture in the watercraft 22 or a status where the gate portion 52 is open. Addition actuation of the pump 82 is needless in either instance and only reduces the lifespan of the pump 82.

In one example, an interlock is provided where in the pump 82 is only operable when the gate portion 52 is raised. For example, a pressure sensor may be provided and connected to an interlink prohibiting actuation of the pump 82 unless the gate portion is pressurized to at least a pressure (P).

In one embodiment, an air pump (compressor) 102 is provided within the watercraft 22, on the dock 61, or elsewhere and a disconnect fitting or valve 74 is mated to an interoperating fitting (e.g., hose 104) on the watercraft 22. The valve disclosed in U.S. Pat. No. 4,478,587 and equivalents have been found effective in such use. In an example wherein the valve 74 is affixed to or near the distal end of a length of hose 72, the valve 74 may be easily reached by a user in the watercraft 22 and retrieved to a position at or near the upper edge of the hull 30 where the air pump 102 is located, optionally with a hose or conduit 104 extending therefrom to reach the valve 74. the hose 72 may be connected to the perimeter tube 46 via one or more releasable connections 79 fixed to the perimeter tube 46. These releasable connections may be frictional clamps which widen as the hose 104 passes an opening therein, ropes, hook and loop fasteners, webbing, and may include snaps or other connectors. The proximal end of the hose 72 is affixed to the gate portion 52 forming a fluid conduit into the gate portion. In this way, air can be pumped into the gate portion 52 and into the rest of the perimeter tube 46 as previously discussed without a fluid (air) connection to the mooring dock or other vessel. This also allows the watercraft barrier 20 to be completely portable, as the air pump 102 does not rely on shore power nor external connections but operates from an independent power source or power supply of the watercraft 22 or may be provided with a power source on the watercraft barrier 20. The distal end of the hose 72 may include a malleable and optionally positively buoyant bumper 77 to protect the valve 74 as well as the watercraft 22 and watercraft barrier 20.

Once the gate portion 52 is repositioned to a closed position 76, and the watercraft barrier 20 is positioned around the watercraft 22, the water pump 82 may be actuated and the water between the watercraft 22 and diaphragm 58 is then evacuated. If the pump 82 is an automatic type pump, the water pump 82 may be configured to turn on automatically to evacuate rainwater, water from waves splashing into the diaphragm 58, or water leaking or otherwise entering the watercraft barrier 20.

In one example the perimeter tube is inflated, not rigid in that it can be folded, rolled, and more easily stored when not full of air.

Testing has shown an unexpected benefit of the apparatus. Where the watercraft barrier 20 is comprised of inflatable perimeter tube 46 and a malleable diaphragm 58, and thus generally does not damage the watercraft 22 upon entry of the watercraft 22 into the watercraft barrier 20, watercraft operators have found docking/mooring into the watercraft barrier 20 in most instances to be easier than docking directly to a common rigid moorage dock 61, anchorage, or mooring buoy even when fenders (bumpers) are employed between the watercraft 22 and the moorage dock 61. The watercraft barrier 20 is specifically designed to not only keep a watercraft 22 clean and dry, but also to help an operator berth (dock) a watercraft 22. The specific design and shape of the perimeter tube(s) 46 combined with the inflatable nature of one example of the perimeter tubes 46, the specific materials used and in one example the different colored material used at the drop point (gate pivot 66), all combine to make the watercraft barrier 20 a berthing aid for watercraft 22. In one example the watercraft barrier 20 is formed with only the perimeter tube 46, without the stern portion 26 and/or without the diaphragm 58 and pumping components. When the gate portion 52 is dropped to the open position 70, it is relatively easy for an operate to navigate the watercraft 22 between the port and starboard perimeter tubes 46 and any offset from a center position is corrected as the vessel collides with the perimeter tube 46 without damage to either in nearly all instances. The perimeter tube 46 thus self-aligns the watercraft 22 therein.

In use, the watercraft 22 may not be raised above a normal floating position by the watercraft barrier 20. The watercraft 22 is protected by the perimeter tube 46, and diaphragm 58 as disclosed above.

The watercraft barrier 20 may also comprise a plurality of handles 89, as shown in FIG. 2, for grasping such as for repositioning of the dry dock 20. The handles 89 may be especially useful in carrying the watercraft barrier 20 such as when not inflated and repositioning the watercraft barrier 20. In one example, as shown in FIG. 1 and FIG. 2, the handles 89 are positioned on the laterally outward surface of the perimeter tube 46, and in this position the handles 89 reduce direct contact between the mooring dock 61 and the inflatable perimeter tube 46. This positioning substantially reduces the potential for damage to the perimeter tube 46 as the perimeter tube 46 may have little or no direct contact with the relatively hard, abrasive, and potentially sharp portions of the mooring dock 61.

While each watercraft barrier 20 may be custom fit to a particular watercraft 22 in transverse 16 width, vertical 14 depth, and longitudinal 12 length, or provided in a variety of sizes for common watercraft 22, alternatively a watercraft adjustment system 106 may be provided. The watercraft adjustment system 106 may be configured to be adjustable or modular, and attached to the perimeter tube 46 so as to allow watercraft 22 of various sizes and configurations to be used with a perimeter tube 46 and diaphragm 58 not specifically configured for a particular length of watercraft 22. In particular, the watercraft adjustment system 106 is configured to adjust the operational length of the watercraft barrier 20 from a point of contact where the watercraft 22 contacts the adjustment system 106 and the gate pivot 66 relative to the propeller(s) 34 and/or shaft(s) 36 to ensure that as the watercraft 22 is positioned in the watercraft barrier 20 at an optimal longitudinal 12 position. The adjustment system 106 provided to ensure that components of the drive mechanism to not damage the diaphragm 58 nor that the hull 30 damages the perimeter tube 46 nor diaphragm 58. A significant contact situation of the diaphragm 58 with the propeller(s) 34 may also hinder operation of the drive mechanism of the watercraft 22.

Figure 5:
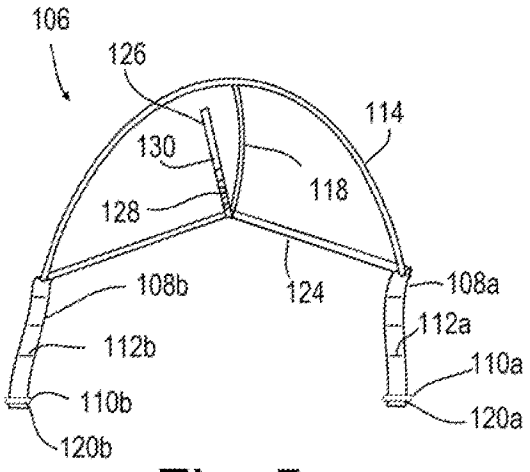
FIG. 5 is an isometric view of one example of a watercraft position adjustment system shown in FIG. 1.

Looking to FIGS. 1, 2, and 5 are shown one example of a watercraft adjustment system 106 component of the watercraft barrier 20. This adjustment system 106 in one example comprising a longitudinal component(s) 108 (108*a* and 108*b*) with a connector/adjuster 110 (110*a* and 110*b*) which allows positioning of the watercraft adjustment system 106 relative to the perimeter tube(s) 46. In one example, the longitudinal component is removably attached to the perimeter tube 46 via lashing points 60, handles 89, or equivalent mounting structures including buckles 120, hook and loop, knots, polymer welding, adhesives, etc. These attachment points as previously discussed may be welded, adhered, or otherwise attached with a release force less than the force that would damage the perimeter tube 46. Thus, for example if the watercraft 22 enters the watercraft barrier 20 with excessive speed, the adjustment system will release from the perimeter tube 46 rather than damaging the perimeter tube 46.

In one example, the longitudinal component(s) 108 have markings 112 thereon to assist in ensuring an even bilateral adjustment of the watercraft adjustment system 106 relative to the perimeter tubes 46. The markings 112 may also correlate to specific watercraft 22, such as specific marking for boats of water length of 24', 30' 40, etc. The markings 112 also ensuring that the watercraft adjustment system 106 is transversely centered. The markings 112 may be ink, paint, stitching, or any other suitable marking. These longitudinal components 108 may be made of webbing, straps, ropes, belts, and may be flexible, rigid, or semi-rigid depending on the use thereof.

In one example, the watercraft adjustment system 106 includes a tensile catch 114. The tensile catch 114 in one example extending transversely 16 between the longitudinal components 108 and vertically above the upper surface of the perimeter tube(s) 89. In one example the tensile catch 114 engages (catches) a bow eye 116 or other structure of the watercraft 22 as the watercraft 22 enters the watercraft barrier 20 This contact ensuring that the drive mechanism (such as the propeller 34) does not pass the gate pivot 66 of the gate portion 52 in the open position 70. Thus, the drive mechanism does not contact the diaphragm 58 nor other components of the watercraft barrier 20 while the drive mechanism is engaged for propulsion. Such a condition very likely to damage the diaphragm 58 and the drive mechanism. Where the tensile catch 114 is longitudinally adjustable via the longitudinal components 108 or equivalents, the watercraft barrier 20 can be used with watercraft 22 of various lengths or effective lengths dependent upon the position of the drive mechanism (propeller 34) relative to the hull 30.

For example, an operator with a watercraft 22 with an overall length of 24' with a propulsion system using an outboard engine(s) attached outboard of the transom 122 may set the tensile catch 114 to an effective length from the gate pivot 66 of approximately 24'. In another example, an operator with a watercraft 22 with an overall length of 24' with a propulsion system using an inboard engine with shaft 36 and propeller(s) 34 longitudinally inward of the transom 122 may set the tensile catch 114 to an effective length from the gate pivot 66 at substantially less than 24' so that the propeller 34 does not contact the diaphragm 58 while rotating.

In one example, the tensile catch 114 includes a tensile component 130 and a support component or strut 118. In one example, the tensile component 130 comprises a strap, webbing, rope, etc., and the support component or strut 118 comprises a rod, or similar structure formed of wood, spring metal, fiberglass, polymer, etc. configured to hold the tensile component 130 in proper position to engage the bow eye 116 or equivalent. In one example, the support component is positioned within the tensile component.

The example shown comprises an optional semi-rigid or rigid strut 118 which may extend generally below the plane of the catch 114. The strut 118 holding the catch 114 in the desired vertical position.

The example shown also comprises an optional transverse component 124. The transverse component 124 may be attached to and extend between the longitudinal component(s) 108 or may be otherwise supported on the perimeter tube 46. In the example shown, the strut 118 extends from the cross-component 124 to the tensile catch 114, supporting the tensile catch 114 in the desired position. The cross-component 124 also may be a strap, webbing, rope, etc.

In one example the longitudinal components 108*a*, 108*b*, and the cross-component 124 are a unitary structure, such as a single length of strap, webbing, rope, etc. with a separate tensile catch 114, and strut 118 attached thereto by screws, stitching, adhesives, rivets, knots, or formed therewith via molding, casting, weaving, etc.

In the example shown, to maintain the watercraft adjustment system 106 from rotating about a transverse axis, such as rotating about the lashing points 60 or ends of the tensile catch 114, a bow component 126 may be utilized. The bow component 126, attached to the cross-component 124 as shown, the strut 118, the tensile catch 114, or other structures and extending toward the bow portion 38 of the barrier 20.

In one example, the bow component 126 extends toward a forward (bow) lashing point 128 and attaching thereto in a similar manner to the method and structures used to attach the longitudinal components 108 to the lashing points 60.

In one example, the bow component 126 comprises an elastic/tensile material. In one example this may be accomplished by connecting an elastic member 128 to a tensile component 130 wherein the tensile component 130 is bendable or foldable with the force exerted by the elastic component. This may be accomplished by sewing a length of elastic material (elastic member 128) to or inside the tensile component 130 wherein the stretched length of the elastic member 128 is equivalent to the length of the tensile component 130 attached thereto. As the force stretching the elastic component is released, the tensile component will fold or bend to a shorter length. Thus, when so used as shown in FIG. 1, or 2, the bow component 126 remains taught even with movement of the perimeter tube 46 and or components of the watercraft adjustment system 106.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept. The invention illustratively disclosed herein suitably may be practiced in the absence of any element which is not specifically disclosed herein.

The invention claimed is:

1. An inflatable watercraft barrier comprising:

a perimeter tube having a port portion, a starboard portion, and a stern portion;

a diaphragm sealed to the port portion, starboard portion, and stern portion of the perimeter portion to form the watercraft barrier between a watercraft and the water in which the watercraft barrier and watercraft float;

the stern portion of the perimeter tube forming a gate portion which is at least partially selectively repositioned to an orientation below the water's surface;

wherein the gate portion remains attached to port portion, and starboard portion when repositioned, and thus allows the watercraft to enter the watercraft barrier through the gate portion;

a rigid air drain tube extending from the gate portion to the port portion, and/or starboard portion, the air drain tube configured to facilitate air evacuation from the gate portion when the gate portion is being deflated; and the air drain tube at least partially interior of the gate portion.

2. The inflatable watercraft as recited in claim 1 further comprising:

a watercraft adjustment system comprising a tensile catch extending from the perimeter tube;

the tensile catch configured to engage the watercraft so as to maintain the watercraft in position such that a drive mechanism of the watercraft does not contact the watercraft when the gate portion is in an open position.

3. The inflatable watercraft as recited in claim 1 wherein the air drain tube comprises surfaces defining openings along its length to facilitate air drainage from within the gate portion.

4. The inflatable watercraft as recited in claim 1 wherein the air drain tube extends substantially the entire length of the gate portion.

5. The inflatable watercraft as recited in claim 4 wherein the air drain tube extends from the port portion to the starboard portion and is fluidly connected to each of the port portion and the starboard portion.

6. The inflatable watercraft as recited in claim 1 further comprising:

a one-way valve positioned between the port portion, and/or starboard portion, and the gate portion; and the one-way valve configured to allow air to flow to the gate portion from the port portion and/or starboard portion as the gate portion is pressurized.

7. The inflatable watercraft as recited in claim 6 wherein the one-way valve is configured to allow air to flow to the gate portion from the port portion and/or starboard portion as the port portion, and/or starboard portion is pressurized above the pressure of the gate portion.

8. The inflatable watercraft as recited in claim 1 wherein the air drain tube comprises surfaces defining openings along its length to facilitate air drainage from within the gate portion.

9. The inflatable watercraft as recited in claim 8 wherein the air drain tube extends substantially the entire length of the gate portion.

10. The inflatable watercraft as recited in claim 9 wherein the air drain tube extends from the port portion to the starboard portion and is fluidly connected to each of the port portion and the starboard portion.

* * * * *